US008550699B2

(12) United States Patent
Bühler et al.

(10) Patent No.: US 8,550,699 B2
(45) Date of Patent: Oct. 8, 2013

(54) COMPOSITE BALANCE AND METHOD OF MANUFACTURING THE SAME

(75) Inventors: Pierre-André Bühler, Orvin (CH); Marco Verardo, Les Bois (CH); Thierry Conus, Lengnau (CH); Jean-Philippe Thiebaud, Cudrefin (CH); Jean-Bernard Peters, Pieterlen (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 495 days.

(21) Appl. No.: 12/933,538

(22) PCT Filed: Mar. 13, 2009

(86) PCT No.: PCT/EP2009/053001

§ 371 (c)(1),
(2), (4) Date: Dec. 14, 2010

(87) PCT Pub. No.: WO2009/115464

PCT Pub. Date: Sep. 24, 2009

(65) Prior Publication Data

US 2011/0103196 A1 May 5, 2011

(30) Foreign Application Priority Data

Mar. 20, 2008 (EP) ..... 08153093

(51) Int. Cl.
*G04B 17/00* (2006.01)

(52) U.S. Cl.
USPC ..... 368/169; 368/171

(58) Field of Classification Search
USPC ..... 368/124, 127, 169–171
See application file for complete search history.

(56) References Cited

U.S. PATENT DOCUMENTS

| | | | | |
|---|---|---|---|---|
| 322,093 | A * | 7/1885 | Davies | 368/169 |
| 1,859,866 | A * | 5/1932 | Dubois | 368/171 |
| 3,161,012 | A * | 12/1964 | Hug et al. | 368/169 |
| 6,354,731 | B1 * | 3/2002 | Halter | 368/148 |

(Continued)

FOREIGN PATENT DOCUMENTS

| | | |
|---|---|---|
| CH | 60 577 A | 8/1913 |
| CH | 332 885 A | 9/1958 |

(Continued)

OTHER PUBLICATIONS

International Search Report issued in corresponding application No. PCT/EP2009/053001, completed Jun. 15, 2009 and mailed Jun. 19, 2009.

(Continued)

*Primary Examiner* — Vit W Miska
(74) *Attorney, Agent, or Firm* — Griffin & Szipl, P.C.

(57) ABSTRACT

The invention relates to a composite balance (45, 45') formed in a layer of silicon-based material (21) and including a hub (39, 39') connected to a felloe (37, 37') by at least one arm (40, 41, 42, 43). According to the invention, the felloe (37, 37') includes at least one additional part approximately in the shape of a notched ring (23, 23') of higher the than the silicon-based material, which increases the inertia of the balance. The invention also relates to a method 1 of manufacturing this type of balance. The invention concerns the field of timepiece movements.

21 Claims, 4 Drawing Sheets

(56) References Cited

U.S. PATENT DOCUMENTS

| | | | | |
|---|---|---|---|---|
| 8,240,910 | B2 | 8/2012 | Orny et al. | |
| 2003/0179655 | A1* | 9/2003 | Scheufele | 368/127 |
| 2006/0055097 | A1 | 3/2006 | Conus et al. | |
| 2007/0140065 | A1* | 6/2007 | Levingston | 368/127 |
| 2008/0037376 | A1 | 2/2008 | Lippuner et al. | |
| 2010/0054090 | A1 | 3/2010 | Orny et al. | |
| 2012/0320718 | A1 | 12/2012 | Buhler et al. | |

FOREIGN PATENT DOCUMENTS

| | | | |
|---|---|---|---|
| EP | 0 732 635 | A1 | 9/1996 |
| EP | 1 422 436 | A1 | 5/2004 |
| EP | 1 431 844 | A1 | 6/2004 |
| EP | 1 584 994 | A1 | 10/2005 |
| EP | 1 612 627 | A1 | 1/2006 |
| EP | 1 655 642 | A2 | 5/2006 |
| EP | 1 837 722 | A1 | 9/2007 |
| FR | 1 301 938 | A | 8/1962 |
| GB | 1 083 209 | A | 9/1967 |
| GB | 2 416 408 | A | 1/2006 |

OTHER PUBLICATIONS

Notice of Allowance issued in co-pending related U.S. Appl. No. 12/933,528, on Apr. 3, 2013.

* cited by examiner

COMPOSITE BALANCE AND METHOD OF MANUFACTURING THE SAME

This is a National Phase Application in the United States of America of International Patent Application PCT/EP2009/053001 filed Mar. 13, 2009, which claims priority on European Patent Application No. 08153093.3 of Mar. 20, 2008. The entire disclosures of the above patent applications are hereby incorporated by reference.

FIELD OF THE INVENTION

The invention relates to a balance and the method of manufacturing the same and, more specifically, a composite balance.

BACKGROUND OF THE INVENTION

The regulating member of a timepiece generally includes an inertia wheel, called a balance, and a resonator called a hairspring. These parts have a determining role as regards the working quality of the timepiece. Indeed, they regulate the movement, i.e. they control the frequency of the movement.

The balance and the hairspring are different in nature, which makes it extremely complex to manufacture the regulating member, said manufacturing including the manufacture of the balance, the balance spring and the resonant assembly of the two parts.

The balance has thus been manufactured in various materials, but without resolving the isochronism difficulties that are linked to a temperature change in the regulating member on which the balance depends.

SUMMARY OF THE INVENTION

It is an object of the present invention to overcome all or part of the aforecited drawbacks by proposing a composite balance, whose features as a function of temperature can be more easily adjusted and which is obtained via a manufacturing method that comprises fewer steps.

The invention thus relates to a composite balance formed in a layer of silicon-based material and including a hub connected to a felloe by at least one arm, characterized in that the felloe includes at least one additional part, approximately in the shape of a notched ring of larger density than said silicon-based material, for increasing the inertia of said balance.

According to other advantageous feature of the invention:

said at least one additional part is mounted on one of the main faces of the felloe, which amplifies the inertia adjustment;

said at least one additional part is mounted in a recess made in one of the main faces of the felloe;

said at least one additional part projects from one of the main faces of the felloe;

said at least one additional part includes a series of studs spaced at regular intervals to compensate for any thermal expansion in said at least one additional part;

said at least one additional part is formed from a metallic material, such as gold, which has a much higher density than silicon;

the hub includes at least a second additional part for receiving the balance staff, which is driven therein;

said at least one second additional part is mounted on one of the main faces of the hub;

said at least one second additional part is mounted in a recess made in one of the main faces of the hub;

said at least one second additional part projects from one of the main faces of the hub;

said at least one second additional part is approximately cylinder-shaped;

said at least one second additional part is formed from a metallic material;

said at least one arm is slim so as to allow it to deform axially and/or radially in the event of any shocked transmitted to the balance.

The invention also relates to a timepiece, characterized in that it includes a balance according to any of the preceding variants.

Finally, the invention relates to a method of manufacturing a balance including the following steps:

a) providing a substrate made of silicon-based material;

characterized in that it further includes the following steps:

b) selectively depositing at least one metal layer on the substrate to define the pattern of at least one metal part of said balance;

c) selectively etching at least one cavity in the substrate to define the pattern of the balance including said at least one metal layer;

d) releasing the balance from the substrate.

In accordance with other advantageous features of the invention:

step b) includes step e): growing said deposition by successive metallic layers at least partially on the surface of the substrate so as to form a metallic part for increasing the mass of the balance made of silicon-based material and/or a metallic part for receiving an arbour that is driven therein;

step b) includes step f): selectively etching at least one cavity in the substrate for receiving said at least one metal part and step g): growing said deposition by successive metal layers at least partially in said at least one cavity so as to form a metal part for increasing the mass of said third part of silicon-based material and/or a metal part into which an arbour will be driven, step b) includes the last step h): polishing the metal deposition, several composite balances are made on the same substrate, which allows batch manufacture.

BRIEF DESCRIPTION OF THE DRAWINGS

Other features and advantages will appear clearly from the following description, which is given by way of non-limiting illustration, with reference to the annexed drawings, in which.

DETAILED DESCRIPTION OF PREFERRED EMBODIMENTS

The invention relates to a method, generally designated 1, for fabricating a balance 45, 45' for a timepiece movement. As illustrated in FIGS. 1 to 5 and 10, method 1 includes successive steps for forming at least one type of composite balance, i.e. which is preferably formed of two different materials, such as silicon and metal.

Figure 1:
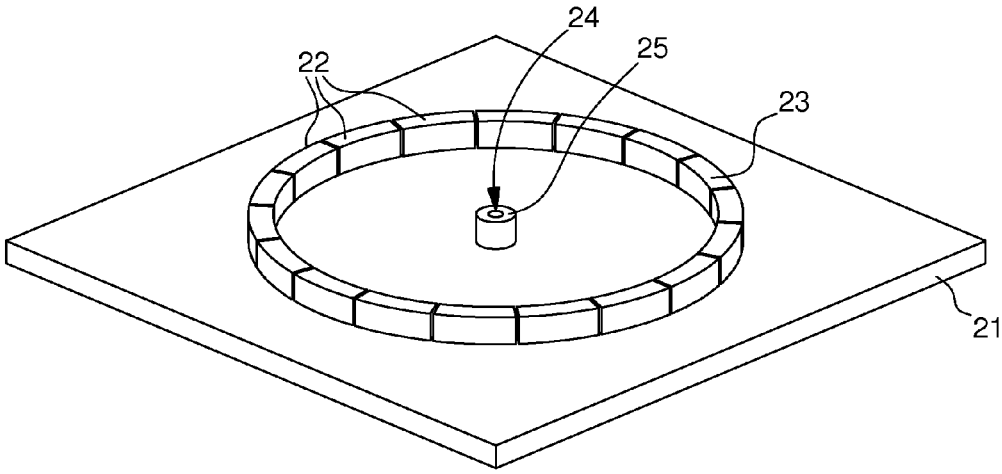
FIGS. 1 and 2 show views of successive steps of the manufacturing method according to a first embodiment.
Figure 3:
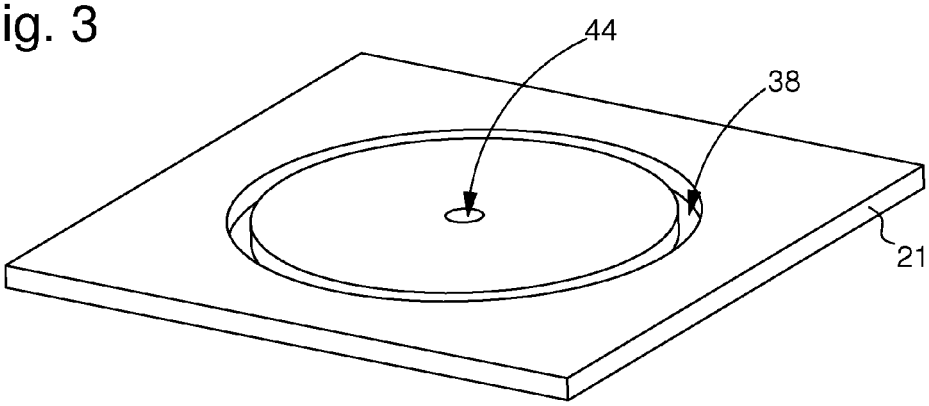
FIGS. 3 to 5 show views of successive steps of the method according to a second embodiment.
Figure 10:
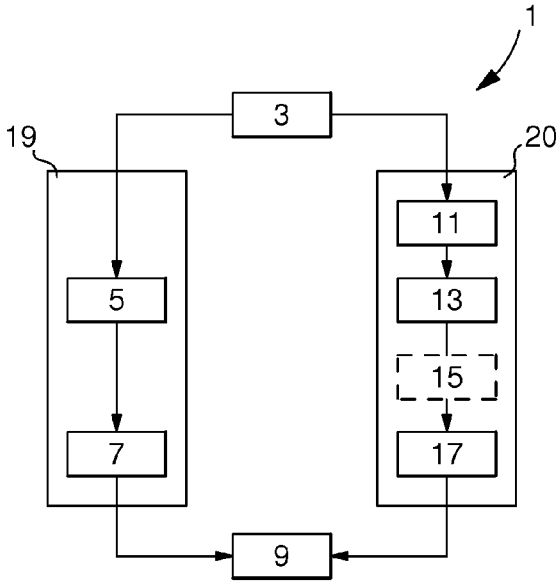
FIG. 10 is a flow chart of the method of the invention.

With reference to FIGS. 1, 3 and 10, the first step 3 consists in taking a substrate 21 that includes a silicon layer. Preferably in this step 3, substrate 21 is selected such that, as seen in FIGS. 1 and 3, its thickness approximately matches the desired thickness of the silicon part of balance 45, 45'. Thus, the thickness of substrate 21 may be, for example, comprised between 100 and 400 μm.

Advantageously according to the invention, after the first step 3, method 1 can comprise two embodiments 19, 20 as illustrated in FIG. 10.

According to a first embodiment 19, in a second step 5, shown in FIG. 1, method 1 includes implementation of a LIGA process (also known by the German name "röntgen-LIthographie, Galanoformung & Abformung") including a series of steps for electroplating, in a particular shape, a metal on substrate 21 using a selectively photostructured resin. As this LIGA process is very well known, it will not be described in more detail here. However, the deposited metal may be, for example, gold or nickel or an alloy of these metals.

In the example illustrated in FIG. 1, step 5 can consist in depositing a notched ring 23 and/or a cylinder 25. In the example illustrated in FIG. 1, ring 23 includes a series of studs 22 shaped approximately in the arc of a circle and it is advantageously used for increasing the mass of the future balance 45. Indeed, one of the advantages of silicon is its insensitivity to temperature variations. However, it has the drawback of having low density.

Consequently, a first feature of the invention thus consists in increasing the mass of balance 45 using metal obtained by electroplating in order to increase the inertia of the future balance 45. However, in order to keep the advantages of silicon, the metal deposited on substrate 21 includes a space between each stud 22 that can compensate for any thermal expansion of ring 23, while avoiding transmitting any stress linked to such expansion to the silicon.

In the example illustrated in FIG. 1, cylinder 25 is for receiving a balance staff, which is advantageously driven therein. In fact, another drawback of silicon is that it has very small elastic and plastic zones, which means that it is very brittle. Another feature of the invention thus consists in tightening the balance staff, not against silicon, but on the inner diameter 24 of metal cylinder 25, electroplated during step 5.

Advantageously, according to method 1, the cylinder 25 obtained by electroplating allows complete freedom as regards its geometry. Thus, in particular, the inner diameter 24 is not necessarily circular, but for example polygonal, which could improve the transmission of forces in rotation with an arbour of matching shape.

Figure 2:
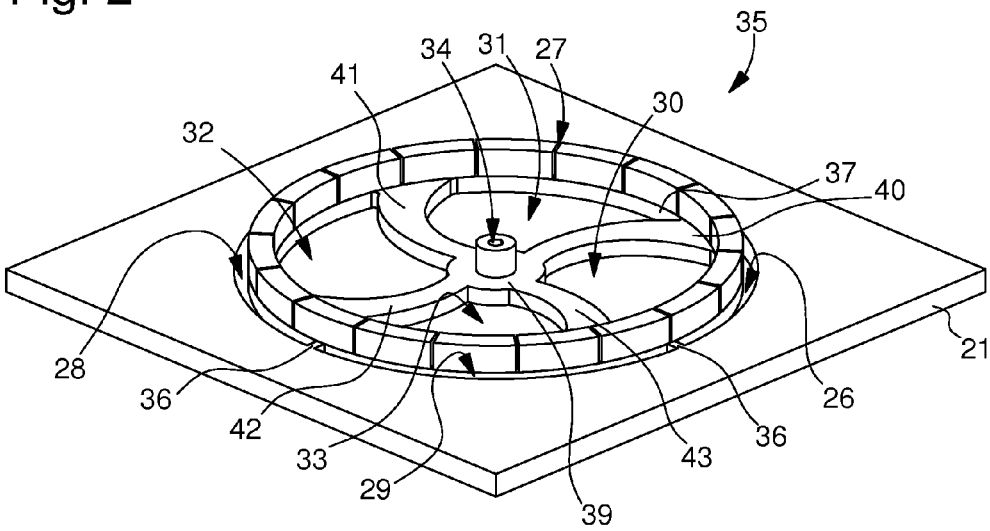

In a third step 7, shown in FIG. 2, cavities 26 to 34 are selectively etched, for example by a DRIE method, in silicon substrate 21.

Cavities 26 to 34 form preferably form the pattern 35 of the future balance 45. As illustrated in the example of FIG. 2, the pattern 35 obtained includes a felloe 37 connected to hub 39 by four arms 40 to 43. However, advantageously according to method 1, the etch over substrate 21 allows complete freedom as to the geometry of pattern 35. Thus, in particular, the number and geometry of the arms may be different, and the rim is not necessarily circular but, may be, for example, elliptical. Moreover, the arms may be slimmer to allow them to deform axially and/or radially in the event of any shock transmitted to balance 45.

It should also be noted that, with inner diameter 24 of metal cylinder 25, cavity 34 made in hub 39 forms a hollow space that can receive an arbour. It will be noted finally that bridges of material 36 are formed to hold pattern 35 to substrate 21.

According to embodiment 19, method 1 ends with final step 9, which consists in releasing the manufactured balance 45 from substrate 21. Advantageously, step 9 is achieved simply by applying sufficient force to balance 45 to break its bridges of material 36. This force can, for example, be generated by machining or manually by an operator.

Figure 6:
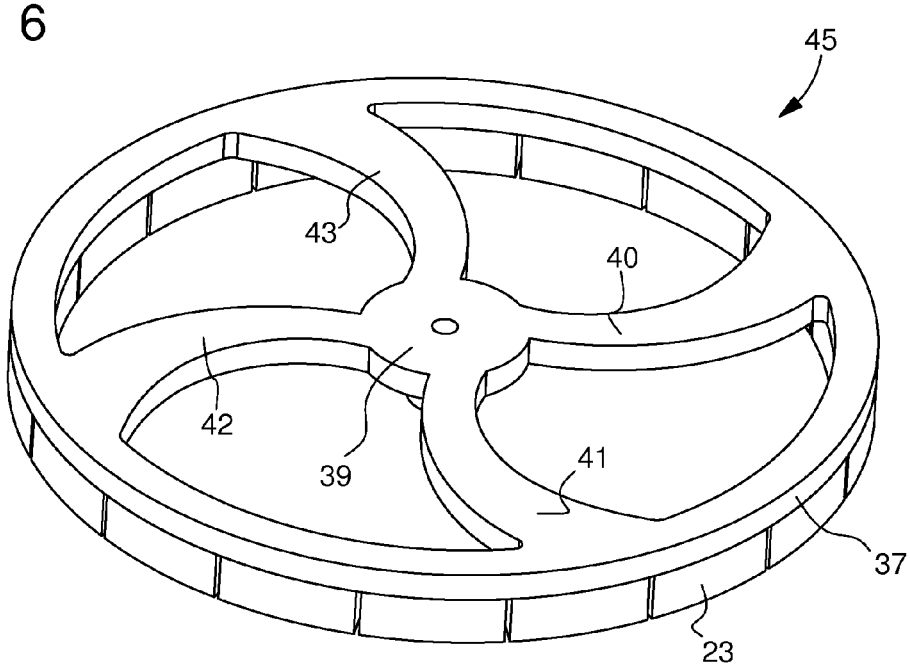
FIGS. 6 and 7 are perspective diagrams of a composite balance according to a first embodiment.
Figure 7:
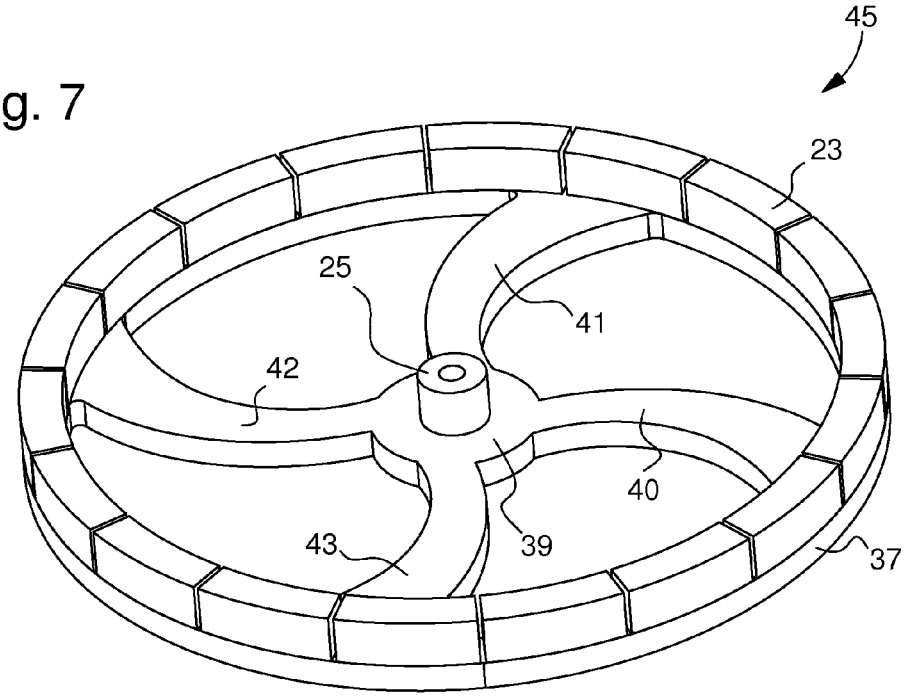

After final step 9, as illustrated in the example of FIGS. 6 and 7, a balance 45 is thus obtained, mainly formed of silicon with one or two metal parts 23, 25. It is thus clear that balance 45 is of the composite type and that it has at least two types of material and is made in one-piece, in that element 35 and elements 23 and/or 25 cannot be separated without being destroyed. Balance 45 includes a hub 39 radially connected to felloe 37 by four arms 40, 41, 42 and 43. Hub 39 is advantageously also axially connected to metal cylinder 25 and felloe 37 includes notched ring 23, over one part of its main faces.

According to a second embodiment 20, method 1 includes a second step 11, shown in FIG. 3, in which cavities 38 and/or 44 are selectively etched, for example, by a DRIE method, in one part of the thickness of silicon substrate 21. These cavities 38, 44 form recesses that can be used as a container for at lest one metal part 23', 25'. As in the example illustrated in FIG. 3, the obtained cavities 38 and 44 may respectively take the form of a ring or disc.

Advantageously, according to method 1, cavities 38 and/or 44 obtained by etching leave complete freedom as to their geometry. Thus, in particular, cavities 38 and/or 44 are not necessarily circular but may be, for example, polygonal.

Figure 4:
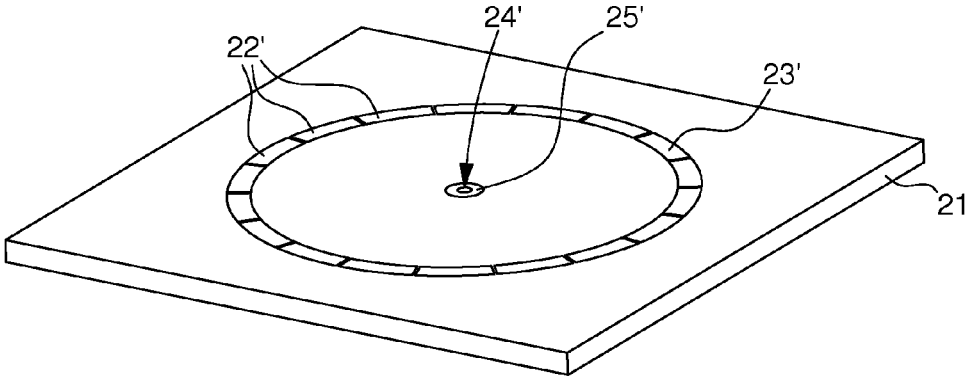

In a third step 13, as illustrated in FIG. 4, method 1 includes implementation of a galvanic growth or LIGA process for filling cavities 38 and/or 44 in a particular metal shape. Preferably, the deposited metal may be, for example, gold or nickel or an alloy of these metals.

In the example illustrated in FIG. 4, step 13 may consist in depositing a notched ring 23' in cavity 38 and/or a cylinder 25' in cavity 44. Moreover, in the example illustrated in FIG. 4, ring 23' has a series of studs 22' approximately in the arc of a circle and it is advantageously used for increasing the mass of the future balance 45'. In fact, as already explained above, one drawback of silicon is that it has low density.

Thus, as for embodiment 19, one feature of the invention thus consists in increasing the mass of balance 45' using metal obtained by electroplating, which increases the inertia of the future balance 45'. However, in order to keep the advantages of silicon, the metal electroplated on substrate 21 has a space between each stud 22' that can compensate for any thermal expansion in ring 23', while preventing transmitting any stress linked to such expansion to the silicon.

In the example illustrated in FIG. 4, cylinder 25' is for receiving a balance staff, which is advantageously driven therein. In fact, as already explained above, one advantageous feature of the invention consists in tightening the balance staff not against the silicon, but on the inner diameter 24' of metal cylinder 25', which is electroplated during step 13. Advantageously according to method 1, the electroplated cylinder 25' allows complete freedom as to its geometry. Thus, in particular, the inner diameter 24' is not necessarily circular but may be, for example, polygonal, which could improve the transmission of forces in rotation with an arbour of matching shape.

Preferably, method 1 can include an fourth step 15, illustrated by dotted lines in FIG. 10, consisting in polishing the metal deposition(s) 23', 25' made during step 13, in order to make them flat.

Figure 5:
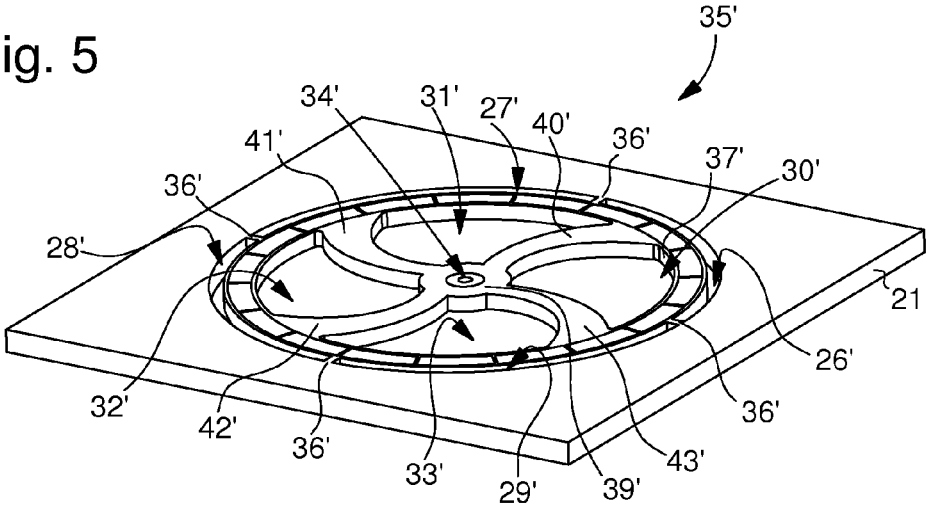

In a fifth step 17, shown in FIG. 5, cavities 26' to 34' are selectively etched, for example, by a DRIE process, in silicon substrate 21.

These cavities 26' to 34' preferably form the pattern 35' of the future balance 45'. As illustrated in the example of FIG. 5, the pattern 35' obtained includes a felloe 37' connected to hub 39' by four arms 40' to 43'. However, advantageously according to method 1, the etch on the substrate 21 leaves complete freedom as to the geometry of pattern 35'. Thus, in particular, the number and geometry of the arms may be different, and the rim is not necessarily circular, but may be elliptical, for example. Moreover, the arms may be slimmer to allow them to deform axially and/or radially in the event of any shock transmitted to the regulating member 45'.

It should also be noted that cavity 34' made in hub 39' forms, with inner diameter 24' of metal cylinder 25', a hollow space that can receive an arbour. It should be noted finally that bridges of material 36' are formed to hold pattern 35' on substrate 21.

Embodiment 20 ends like embodiment 19, i.e. in final step 9 which consists in releasing the manufactured balance 45' from substrate 21. Advantageously, step 9 is achieved simply by applying sufficient force to balance 45' to break its bridges of material 36'. This force can, for example, be generated by machining or manually by an operator.

Figure 8:
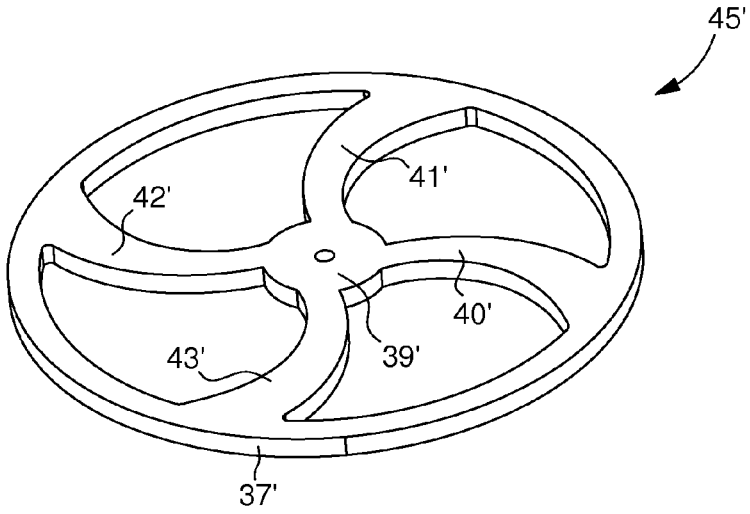
FIGS. 8 and 9 are perspective diagrams of a composite balance according to a second embodiment.
Figure 9:
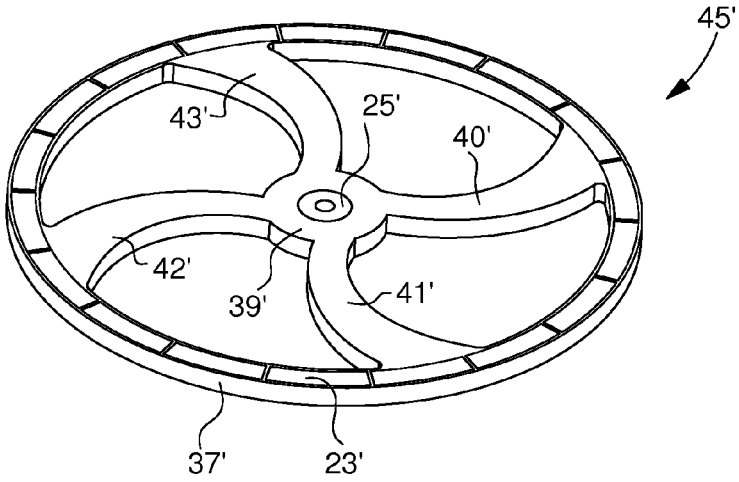

After final step 9, as illustrated in the example of FIGS. 8 and 9, a balance 45' formed mainly of silicon is obtained, with one or two metal parts 23', 25'. It is thus clear that balance 45' is composite in that it includes at least two types of material and one-piece in that element 35' and elements 23' and/or 25' cannot be separated without being destroyed. The balance 45', includes a hub 39' radially connected to the felloe 37' by four arms 40', 41', 42' and 43'. Hub 39' advantageously also includes metal cylinder 25'. Finally, felloe 37' includes notched ring 23'.

Advantageously, according to method 1 of the invention explained above, it is clear that it is possible for several balances 45, 45' to be made on the same substrate 21, which allows batch manufacture.

Of course, the present invention is not limited to the example illustrated, but is capable of various variants and alterations, which will be clear to those skilled in the art. In particular, the hub 39, 39' according to embodiment 19, 20 might not include a metal driving cylinder 25, 25'. Cylinder 25, 25' could then, for example, be replaced by resilient means etched in the silicon hub 39, 39' and could take the form of those disclosed in FIGS. 10A to 10E of EP Patent No. 1 655 642 or those disclosed in FIGS. 1, 3 and 5 of EP Patent No. 1 584 994, which are incorporated herein by reference.

It is also possible for the electroplated metal parts 25, 25' in embodiments 19 and 20 to be inverted, i.e. projecting part 25 of embodiment 19 could be replaced by integrated part 25' of embodiment 20 or vice versa (which only requires minimum adaptation of method 1), or even for part 25' integrated in the hub to project from substrate 21.

In accordance with similar reasoning, it is also possible for metal parts 23, 23' electroplated in embodiments 19 and 20 to be inverted, i.e. projecting part 23 of embodiment 19 could be replaced by integrated part 23' of embodiment 20 or vice versa, or part 23' integrated in the felloe could project from substrate 21.

Moreover, method 1 may advantageously also provide, after release step 9, a step of adapting the inertia of balance 45, 45'. This step could then consist in etching, for example by laser, recesses made in the peripheral wall of felloe 37, 37' and/or on electroplated metal parts 23, 23'. Conversely, inertia-block regulating structures could also be envisaged for increasing the inertia of balance 45, 45'.

Finally, a polishing step like step 15 may also be performed between step 5 and step 7.

The invention claimed is:

1. A composite balance formed in a layer of silicon-based material and including a hub connected to a felloe by at least one arm, wherein the felloe includes one additional part approximately in the shape of a notched ring of higher density than said silicon-based material to increase the inertia of said balance.

2. The balance according to claim 1, wherein said at least one additional part is mounted on one of the main faces of the felloe.

3. The balance according to claim 1, wherein said at least one additional part is mounted in a recess made in one of the main faces of the felloe.

4. The balance according to claim 3, wherein said at least one additional part projects from one of the main faces of the felloe.

5. The balance according to claim 1, wherein the notched ring includes a series of studs spaced at regular intervals to compensate for any thermal expansion in said at least one additional part.

6. The balance according to claim 1, wherein said at least one additional part is formed from a metal material.

7. The balance according to claim 1, wherein the hub includes at least a second additional part for receiving a balance staff that is driven therein.

8. The balance according to claim 7, wherein said at least one second additional part is mounted on one of the main faces of the hub.

9. The balance according to claim 7, wherein said at least one second additional part is mounted in a recess made in one of the main faces of the hub.

10. The balance according to claim 9, wherein said at least one second additional part projects from one of the main faces of the hub.

11. The balance according to claim 7, wherein said at least one second additional part is substantially cylinder-shaped.

12. The balance according to claim 7, wherein said at least one second additional part is formed from a metal material.

13. The balance according to claim 1, wherein said at least one arm is slim so as to enable the axial and/or radial deformation thereof in the event of any shock transmitted to the balance.

14. A timepiece, wherein it includes a balance according to claim 1.

15. A method of manufacturing a composite balance including the following steps:

a) providing a substrate of silicon-based material, wherein it further includes the following steps:

b) selectively depositing at least one metal layer on the substrate to define the pattern of at least one metal part of said balance, c) selectively etching at least one cavity in the substrate to define the pattern of the balance, including said at least one metal layer, d) releasing the regulating member from the substrate.

16. The manufacturing method according to claim 15, wherein step b) includes the following step:

e) growing said deposition by successive metal layers at least partially over the surface of the substrate so as to form a metal part for increasing the mass of the balance.

17. The manufacturing method according to claim 15, wherein step b) includes the following step:

e') growing said deposition by successive metal layers at least partially over the surface of the substrate so as to form a metal part for receiving an arbour that is driven therein.

18. The manufacturing method according to claim 15, wherein step b) includes the following steps:

f) selectively etching at least one cavity in the substrate for receiving said at least one metal part;

g) growing said deposition by successive metal layers at least partially in said at least one cavity so as to form a metal part for increasing the mass of said third silicon part.

19. The manufacturing method according to claim 15, wherein step b) includes the following phases:

f') selectively etching at least one cavity in the substrate for receiving said at least one metal part;

g') growing said deposition by successive metal layers at least partially in said at least one cavity so as to form a metal part for receiving an arbour that is driven therein.

20. The manufacturing method according to claim 15, wherein step b) is followed by the following step:

h) polishing the metal deposition.

21. The manufacturing method according to claim 15, wherein several composite balances are made on the same substrate.

* * * * *